US010954612B2

(12) United States Patent
Hague et al.

(10) Patent No.: US 10,954,612 B2
(45) Date of Patent: Mar. 23, 2021

(54) RIP RESISTANT, NON-PILLING FINE KNIT GARMENTS

(71) Applicant: SHEERTEX INC., Montreal (CA)

(72) Inventors: Katherine Hague, Port Carling (CA); Sheena Repath, Huntsville (CA)

(73) Assignee: Sheertex Inc., Montreal (CA)

( * ) Notice: Subject to any disclaimer, the term of this patent is extended or adjusted under 35 U.S.C. 154(b) by 0 days.

(21) Appl. No.: 16/019,248

(22) Filed: Jun. 26, 2018

(65) Prior Publication Data

US 2018/0368483 A1 Dec. 27, 2018

Related U.S. Application Data

(60) Provisional application No. 62/524,986, filed on Jun. 26, 2017.

(51) Int. Cl.

| | |
|---|---|
| ***D04B 1/08*** | (2006.01) |
| ***D04B 1/26*** | (2006.01) |
| ***D04B 1/16*** | (2006.01) |
| ***A41B 11/14*** | (2006.01) |

(52) U.S. Cl.

CPC ..... *D04B 1/08* (2013.01); *A41B 11/14* (2013.01); *D04B 1/16* (2013.01); *D04B 1/26* (2013.01); *D10B 2321/0211* (2013.01); *D10B 2401/063* (2013.01); *D10B 2501/021* (2013.01)

(58) Field of Classification Search

None

See application file for complete search history.

(56) References Cited

U.S. PATENT DOCUMENTS

| | | | | |
|---|---|---|---|---|
| 4,457,985 A * | 7/1984 | Harpell | A42B 3/062 442/301 |
| 4,897,902 A | 2/1990 | Kavesh et al. | |
| 5,321,960 A * | 6/1994 | Whitt | D02G 3/26 66/182 |
| 5,335,517 A * | 8/1994 | Throneburg | A41B 11/00 2/239 |
| 5,407,620 A * | 4/1995 | Burchette | D01D 5/22 264/103 |
| 5,721,179 A * | 2/1998 | Shi | A41D 31/0055 428/222 |
| 8,806,902 B2 | 8/2014 | Henssen | |
| 9,138,961 B2 | 9/2015 | Bhatnagar et al. | |

(Continued)

FOREIGN PATENT DOCUMENTS

| | | |
|---|---|---|
| CN | 101953518 A | 1/2011 |
| CN | 104452035 A | 3/2015 |
| CN | 105401317 A | 3/2016 |

OTHER PUBLICATIONS

"Sheerly Genius" https://sheerlygenius.com/(Accessed Jun. 7, 2018).

(Continued)

*Primary Examiner* — Megan E Lynch

(74) *Attorney, Agent, or Firm* — Seed IP Law Group LLP

(57) ABSTRACT

The present invention relates to knits that can be used to make rip-resistant sheer hosiery or similar garments, using a specific combination of UHMWPE fiber and stretch fiber, such as spandex. The knit has rip-resistant and anti-microbial properties. Details are provided to avoid problems with pilling and the appearance of bald spots during use. A variation of the knit is useful for activewear.

21 Claims, 6 Drawing Sheets

(56) References Cited

U.S. PATENT DOCUMENTS

| | | | | |
|---|---|---|---|---|
| 9,243,354 | B2 | 1/2016 | Tam et al. | |
| 9,896,798 | B2 | 2/2018 | Vanwunnik et al. | |
| 2006/0088712 | A1 | 4/2006 | Threlkeld et al. | |
| 2007/0144135 | A1 | 6/2007 | Kolmes et al. | |
| 2009/0301139 | A1 | 12/2009 | Kolmes et al. | |
| 2010/0050699 | A1* | 3/2010 | Kolmes | A41B 9/00 66/174 |
| 2011/0117352 | A1 | 5/2011 | Shalaby et al. | |
| 2012/0278981 | A1* | 11/2012 | Ialenti | A41B 11/02 2/468 |
| 2013/0000014 | A1* | 1/2013 | Bakker | A41B 11/14 2/409 |
| 2014/0000007 | A1 | 1/2014 | Fukushima et al. | |
| 2014/0165251 | A1* | 6/2014 | Prickett | D02G 3/442 2/2.5 |
| 2014/0223880 | A1* | 8/2014 | Henssen | D02G 3/04 57/256 |
| 2014/0273696 | A1* | 9/2014 | Tam | D03D 13/008 442/189 |
| 2015/0052654 | A1* | 2/2015 | Thom | A41B 11/00 2/2.5 |
| 2016/0010246 | A1* | 1/2016 | Nakai | D02G 3/402 57/244 |
| 2016/0017521 | A1* | 1/2016 | Thomson | D03D 15/08 66/171 |
| 2016/0206462 | A1* | 7/2016 | Iida | A61F 5/0111 |
| 2017/0227331 | A1* | 8/2017 | Hexels | F41H 1/02 |
| 2018/0002839 | A1* | 1/2018 | Liao | D04B 1/16 |

OTHER PUBLICATIONS

"Indestructible Fully Fashioned Stockings" Post by JayFFsay http://forum.stockingshq.com/index.php?/topic/22482-indestructible-fully-fashioned-stockings/.

"Launch HN: SheerlyGenius (YC W18)—Indestructible Tights from Bulletproof Fiber" https://news.ycombinator.com/item?id=16377751 (Accessed Jun. 11, 2018).

* cited by examiner

RIP RESISTANT, NON-PILLING FINE KNIT GARMENTS

REFERENCE TO RELATED APPLICATIONS

This application claims the benefit of U.S. provisional application No. 62/524,986.

FIELD OF THE INVENTION

The present invention relates to knits that can be used to make rip-resistant sheer hosiery or similar garments, using a specific combination of UHMWPE fiber and stretch fiber, such as spandex.

BACKGROUND

Sheer hosiery, whether in the form of sheer tights, stockings or trouser socks, is traditionally very fragile, and easy to rip.

The sheerness of hosiery is measured in denier. Denier is a unit of measure for the linear mass density of fibers, and is the mass in grams per 9000 meters of the fiber. Sheerness refers to the level at which light is able to travel through a hosiery garment. Sheerness is determined by the denier of the fibers used in the construction of the hosiery garment. Hosiery garments produced using lower denier measurements of 1 to 30 will be sheer in appearance, allowing the most light to pass through. Hosiery produced using fibers that are 31-100 denier, are termed semi-opaque to nearly opaque in appearance. Above 100 denier no longer produce sheer hosiery, allowing no light to pass through.

Traditional fibers used in hosiery (i.e.; nylon, Lycra™, polyester) have very low tensile strength, which results in very weak garments, particularly at lower deniers. Sheer hosiery products (30 denier and below) made using these fibers are very fragile. They can easily be ripped by hand, foot or hang nail, and are generally considered disposable. Tensile strength is the maximum amount of tensile stress that can be applied to a material before the material ceases to be elastic, and is measured in units of pascals (Pa) or newtons per square metre of $N/m^2$.

There is a need for a commercially viable sheer elastic knit that is not easy to rip.

There are prior attempts to create form-fitting clothing that has a high resistance to cutting. US 2010/0050699 of Kolton discusses using a high performance fiber (one of which is UHMWPE), combined with a suitable high performance nylon, to produce several types of protective wear, including hosiery. However, this application is focussed on producing protective clothing, and does not focus on low denier products or high gauge knitting, or the challenges of producing coloured materials when using UHMWPE.

SUMMARY

The present invention relates to a rip-resistant, non-pilling knit that is lightweight, flexible and has improved durability over traditional knits used in hosiery and activewear and can be made in a variety of colors. When applied to sheer hosiery the present invention improves upon the durability, and moisture wicking properties of traditional sheer hosiery. It is rip-resistant and anti-microbial, yet maintains the same level of sheerness, flexibility, pill resistance and overall weight of traditional sheer hosiery.

In the sheer hosiery space, 32 gauge knits with an appearance of 30 denier and below, this invention is suitable for apparel products such as sheer tights, stockings, or trouser socks. When applied to non-sheer knits, 18 gauge and higher knits made with a total denier of 30-220, the present invention produces a knit that is more durable and lighter weight than traditional knits, with the added benefit of being anti-microbial.

In accordance with the present invention, there is provided a knit consisting of at least one UHMWPE fiber and at least one stretch fiber, where the at least one UHMWPE fiber is colored using a non-additive method, and the at least one UHMWPE fiber and the at least one stretch fiber are either plated or served. In one aspect of this invention, the at least one UHMWPE fiber has a denier of 30 or less, the at least one UHMWPE fiber is twisted, the at least one stretch fiber is a clear stretch fiber with a denier between 5 and 100, and the knit has a gauge of at least 32, and the resulting knit has a total visible denier of 30 or less. In another aspect of this invention, the at least one UHMWPE has a denier between 20 and 30. In another aspect of this invention, the at least one stretch fiber is clear spandex with a denier between 5 and 10. In another aspect of this invention, the at least one stretch fiber is clear spandex with a denier between 40 and 70.

In still another aspect of this invention, there is only one UHMWPE fiber and only one stretch fiber.

In another aspect of this invention, the UHMWPE fiber has a twists per inch (TPI) between 4 and 52. In another aspect of this invention, the UHMWPE fiber has a TPI between 6 and 20. In another aspect of this invention, the UHMWPE fiber has a TPI of around 20. In another aspect of this invention, the UHMWPE fiber has a TPI of around 12.

In another aspect of this invention, the at least one UHMWPE fiber and the at least one stretch fiber are served and the at least one UHMWPE fiber and the at least one stretch fiber have a twist between 100-450 twists per meter. In another aspect of this invention, the served at least one UHMWPE fiber and the at least one stretch fiber have a twist between 1000-1500 twists per meter. In still another aspect of this invention, the served at least one UHMWPE fiber and the at least one stretch fiber have a twist of around 1500 twists per meter.

In another aspect of this this invention, there is provided tights, stockings or trouser socks comprising the inventive knit. In another aspect of this invention, the tights, stockings or trouser socks are treated with abrasion pads in areas of high abrasion.

In another aspect of this invention, the at least one UHMWPE fiber has a denier between 10 and 100, the at least one stretch fiber has a denier between 20 and 140, and the knit has a gauge of at least 18, and the resulting knit has a total visible denier or 30 or higher. In another aspect of this invention, the at least one UHMWPE fiber has a denier between 30 and 50, the at least one stretch fiber has a denier between 40 and 100.

In accordance with the present invention, there is provided a knit comprising at least one UHMWPE fiber and at least one stretch fiber, where the at least one UHMWPE fiber is twisted, the at least one UHMWPE fiber is colored using a non-additive method, and the at least one UHMWPE fiber and the at least one stretch fiber are either plated or served. In an aspect of this invention, the at least one UHMWPE fiber has a denier of 30 or less, the at least one stretch fiber is a clear stretch fiber with a denier between 5 and 100, and the knit has a gauge of at least 32, and the resulting knit has a total visible denier of 30 or less. In still another aspect of this invention, there is only one UHMWPE fiber and only one stretch fiber.

In accordance with the present invention, there is provided a knit consisting of at least one UHMWPE fiber and at least one stretch fiber, where the at least one UHMWPE fiber is twisted, the at least one UHMWPE fiber is colored using a non-additive method, the at least one UHMWPE fiber and the at least one stretch fiber are served at around 1500 twists per meter, the at least one UHMWPE has a denier between 20 and 30, and the at least one stretch fiber is clear, and the resulting knit has a denier below 30. In another aspect of this invention, there is only one UHMWPE fiber and only one stretch fiber.

BRIEF DESCRIPTION OF THE DRAWINGS

The invention is described with reference to the following drawings.

DETAILED DESCRIPTION

Figure 1:
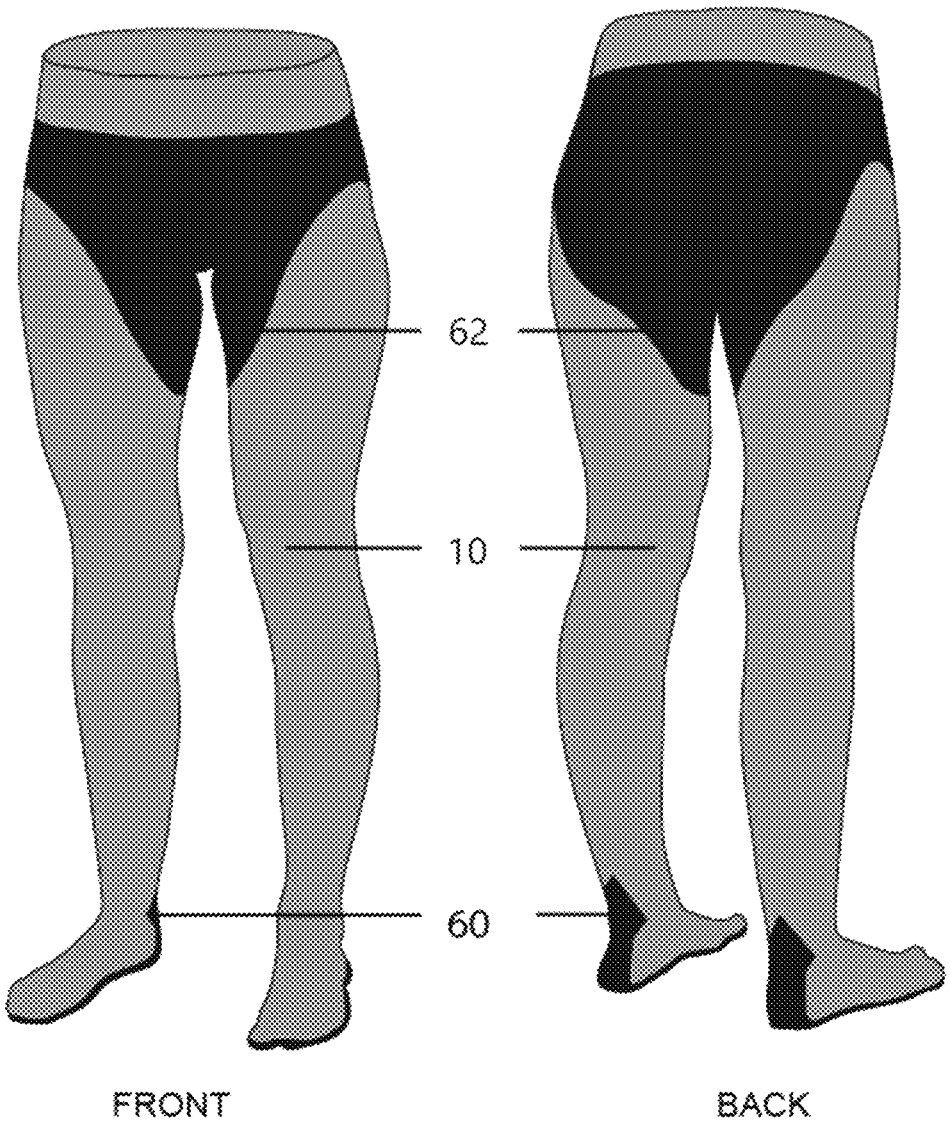
FIG. 1 illustrates an exemplary embodiment in a seamless pair of sheer tights, featuring abrasion pads on the heels and thighs.

The term "sheer" used herein refers to a garment with the appearance of 30 denier or below. This is a commonly accepted industry measure for a garment to be considered sheer.

The term "denier" used herein refers to a unit of weight indicating the fineness of fiber filaments. It can be measured in mass in grams per 9,000 meters.

The term decitex (dtex) refers to an alternate unit of weight indicating the fineness of fiber filaments. It can be measured in mass in grams per 10,000 meters.

The term "tensile strength" used herein relates to the durability of the garment and is measured by the maximum stress that a material can withstand while being stretched or pulled before breaking. It is measured as force per unit area, and can be expressed in units of gram force (gf) and centi-newton (cN) per dtex.

The term "elongation" used herein refers to the stretch of individual fibers and composite yarns which results in the elasticity of the final embodiment of the present invention. Elongation is measured as a percentage of the starting length.

The term "fiber" used herein refers to a single origin base material made up of one or more filaments.

The term "filament" used herein refers to a single fibril of material that can be on its own a fiber, or can be combined with other filaments to create a multifilament fiber.

The term "pilling" used herein refers to a surface defect that occurs in hosiery when and individual fiber or filament gets caught and pulls away from the rest of the knit. Pilling is considered unsightly and can render a pair of sheer hosiery unusable.

The term "knit" used herein refers to the fabric created by combining one or more fibers on a flat or circular knitting machine.

The term "gauge" refers to the number of needles on the knitting machine. A high gauge knitting machine (32 gauge and above) is required to produce sheer hosiery like sheer tights, stockings and trouser socks and a low gauge knitting machine (18 to 32 gauge) is used to produce heavier garments like leggings, bodysuits, socks, shirts and other activewear. Gauge is also used to refer to the knit that has been produced by a machine: in other words, a knit made on a 32 gauge machine is a 32 gauge knit.

The term "ends" refers to the number of bobbins of fiber being fed into a given knitting machine used to create the present invention.

The term "UHMWPE" stands for ultra high molecular weight polyethylene fibers, also known as high-modulus polyethylene, (HMPE), or high-performance polyethylene (HPPE).

The term "colored UHMWPE" means UHMWPE that has been coloured (made non-white) by a non-additive coloring process.

The term "plating" used herein refers to a technique of knitting two fibers together in two distinct layers. Where one fiber stays in the back, behind the front yarn despite being knit in the same stitch.

The term "serving" used herein refers to the process of spinning two fibers together to produce a composite yarn.

The term "apparent denier" used herein refers to the total denier of the visible fibers used in the knit, with clear fibers being considered non-apparent for the purposes of this application.

The term "bulk" used herein refers to the addition of new fibers that add to the total apparent or non-apparent denier of the fiber.

The term "non-additive" used herein refers to coloring, typically dye-ing, methods that do not increase the total apparent or non-apparent denier of the fiber.

The term "bald spots" used herein refers to a defect that occurs when UHMWPE is plated with a stretch fiber, such as spandex (also called elastane). It occurs when the stretch fiber layer wears out before the UHMWPE layer. It is more apparent in higher gauge knits than in low gauge knits.

The term "abrasion pads" used herein refers to the use of non-UHMWPE knits and additive coatings in areas of high friction/abrasion to reduce bald spots and holes which are a result of damage to the knit. Abrasion pads are important in garments made from high gauge knits as described herein and optional in low gauge knits.

The term "compression" refers to garments that are designed to apply pressure. Compression can be measured in millimeters of mercury (mmHg).

When considering knits for use in sheer hosiery, there are three primary characteristics to be balanced: elongation, strength, and sheerness. There is no single fiber that meets all three of these characteristics for sheer hosiery. In addition to these primary characteristics, it would be desirable for knits to be lightweight, and have antimicrobial properties. In some cases, compression is also desired.

UHMWPE is a polymer based, extruded, multifilament fiber, with little to no elongation and a notably high tensile strength fiber. The use of coloured UHMWPE of low denier allows the creation of sheer hosiery with significant rip-resistance. The use of UHMWPE adds additional benefits not derived from knits made without UHMWPE: UHMWPE provides a cooling effect, is lighter than traditional hosiery fibers, is moisture wicking, and antimicrobial. The antimicrobial and moisture wicking properties stem from the UHMWPE being hydrophobic.

Figure 2:
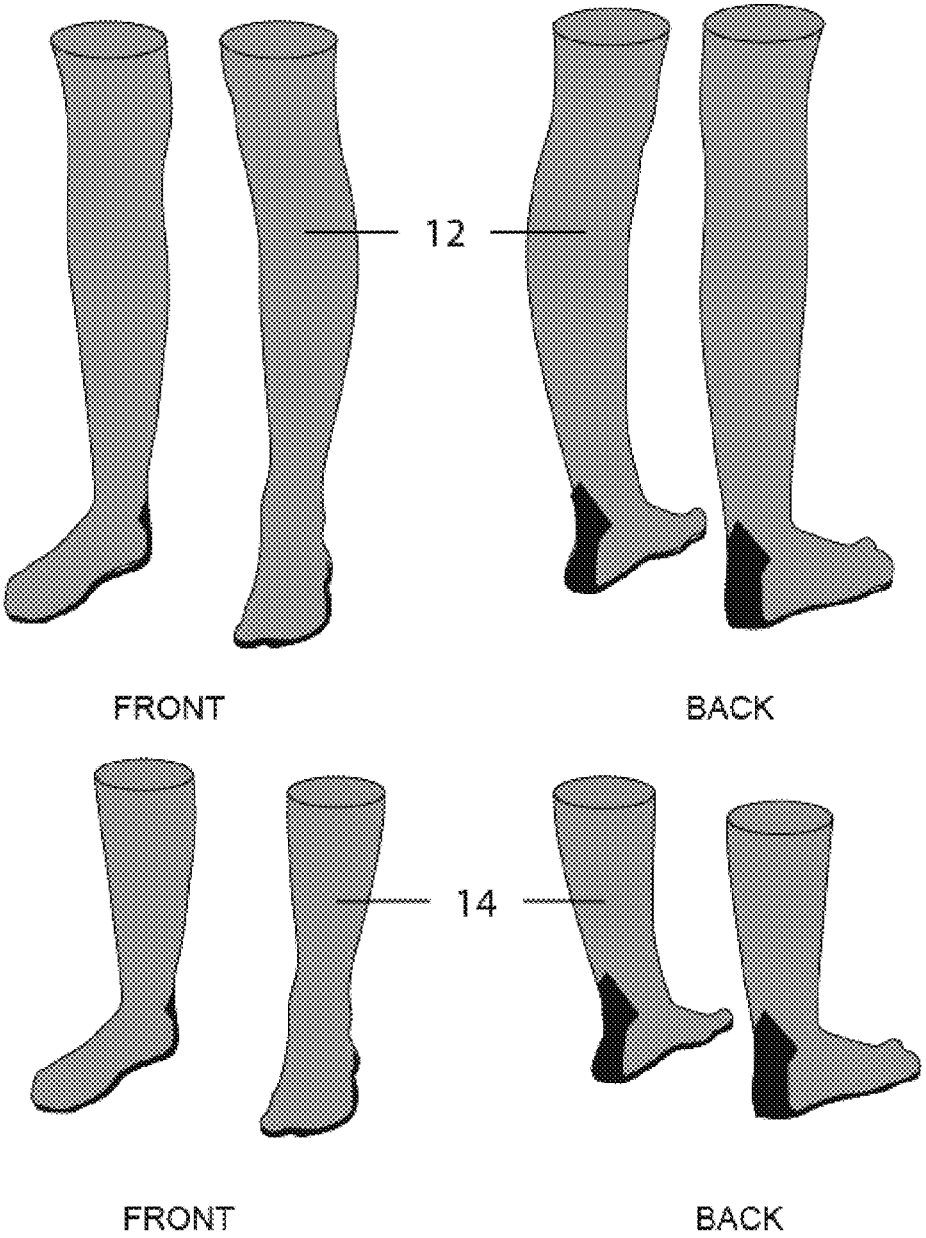
FIG. 2 is an Illustration of some other possible sheer embodiments: stockings, trouser socks.

Turning to FIG. 1, there is illustrated tights 10, which would be a typical use for this invention. Turning to FIG. 2, there is illustrated stockings 12 and trouser socks 14, which are other examples of products where this invention could be used. As set out below, this application describes how low denier UHMWPE fibers can be used for hosiery products as seen in FIGS. 1 and 2.

The present invention is a knit with two low denier fibers; one a stretch fiber for elongation, and one a high tenacity fiber for strength. The high tenacity fiber used to achieve the present invention is UHMWPE. In order to achieve strength and stretch in the final product, UHMWPE is combined with the stretch fiber in a way that does not compromise the strength or stretch of the end product as described below.

No additional fibers beyond the UHMWPE and the stretch fiber are required. Additional fibers would either unnecessarily add weight and bulk to the final product, or would decrease the percentage of UHMWPE in the knit. A higher UHMWPE content means a more durable end product with greater antimicrobial properties. Generally, any hydrophilic fiber is undesirable, with the exception of the use of spandex (also called elastane) or alternative stretch fibers which are required to achieve elongation.

Knits for sheer applications, are knitted on high gauge knitting machines, typically 32 gauge and higher. When knitting UHMWPE on high gauge knitting machines designed for sheer hosiery, the applicant found that this multifilament fiber has a tendency to pill more than traditional hosiery fibers which tend to be monofilament. To solve this problem, in sheer hosiery applications the UHMWPE used may be twisted prior to being knit with the stretch fiber (such as spandex).

Figure 3A:
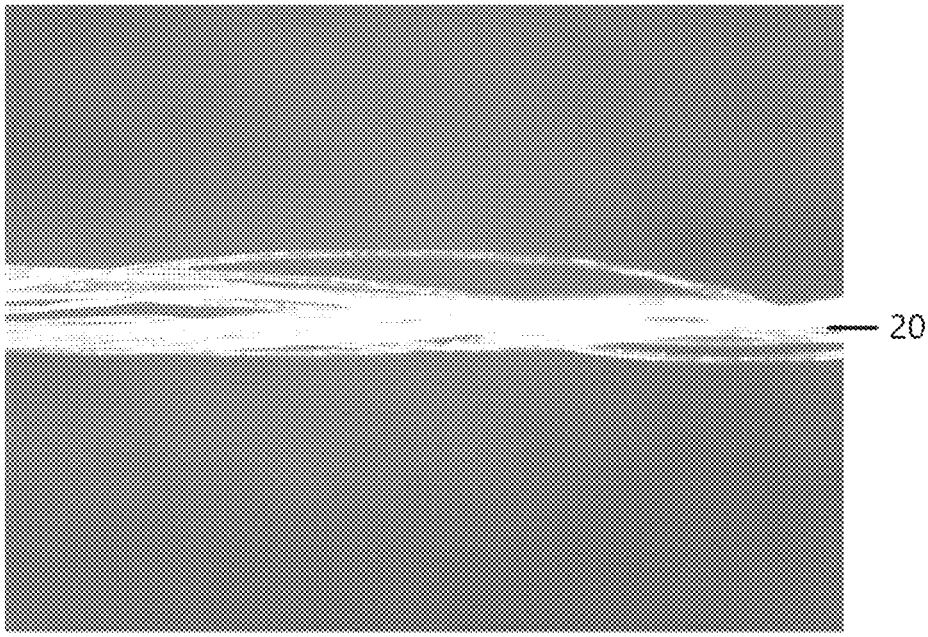
FIG. 3A is a photograph of non-twisted white UHMWPE taken at 225 times magnification.
Figure 3B:
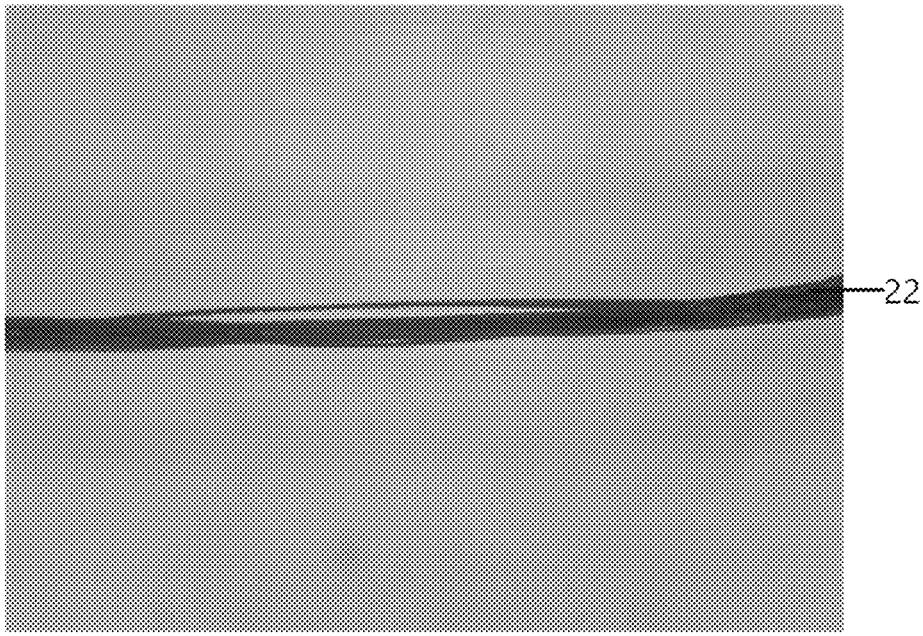
FIG. 3B is a photograph of twisted black UHMWPE with 12 TPI taken at 225 times magnification.
Figure 4:
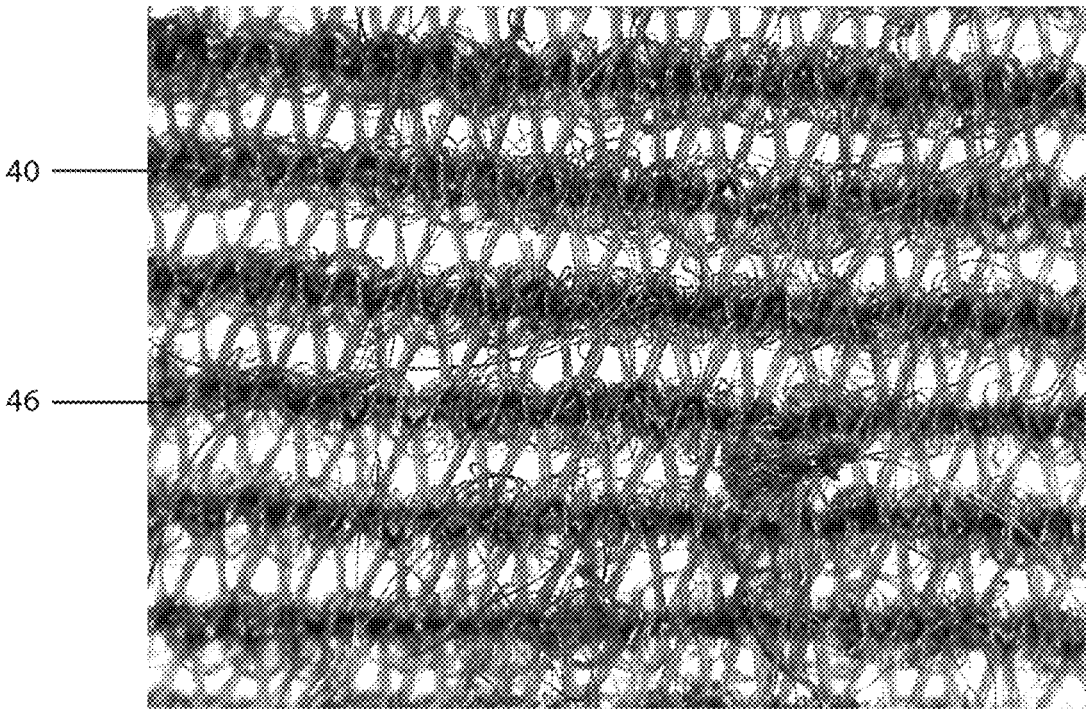
FIG. 4 is a is a photograph of pilling.

FIG. 3A is a photograph of non-twisted UHMWPE, and FIG. 3B is a photograph of twisted UHMWPE. The twisting is required to keep the filaments together, increase strength and reduce pilling. Turning to FIG. 3A, there is a 20 filament, 30 denier white UHMWPE fiber 20 that is not twisted. Turning to FIG. 3B, there is a 20 filament, 30 denier black UHMWPE fiber 22 twisted at 12 twists per inch (TPI). FIG. 4 shows pilling that can occur in a knit when using untwisted UHMWPE, as seen in FIG. 3A. Turning to FIG. 4, there is a knit 40 comprising a set of untwisted UHMWPE fibers plated with untwisted UHMWPE fibers. After use, pills 46 have developed, where individual fibers have pulled away from the rest of the knit.

Twisting of the fiber can be done on several types of twisting machines known in the art. To maintain strength, twists per inch (TPI) should not be too high, as this would reduce the strength of the UHMWPE fibers and can produce an unbalanced fiber. In a preferred embodiment, 30 denier UHMWPE has a TPI between 4-20 TPI. In another embodiment, the UHMWPE has a TPI between 6-15. In a preferred embodiment, the UHMWPE has a TPI of 15. In another preferred embodiment, the UHMWPE has a TPI of 12.

The issue of pilling did not present itself on lower gauge knits, 18-28 gauge. These gauges used for non-sheer applications like activewear products, and thus twisting for these applications is optional.

Experiments have shown that simply mixing UHMWPE and spandex, while resulting in a knit with high elongation, results in a loss of the strength characteristic of the UHMWPE reducing the rip resistance of the knit. Composite yarns that are created using air tacking are unsuitable for use with sheer hosiery, due to increased pilling of the UHMWPE. Mixing the two fibers in a conventional knit without plating the knit or serving the fibers into a single yarn may result in compromised tensile strength of the UHMWPE in the composite yarn.

Experiments have established two methods that can be used to effectively achieve stretch in the final knit without compromising the strength properties provided by the UHMWPE: plating knit structure or serving yarn.

Figure 5A:
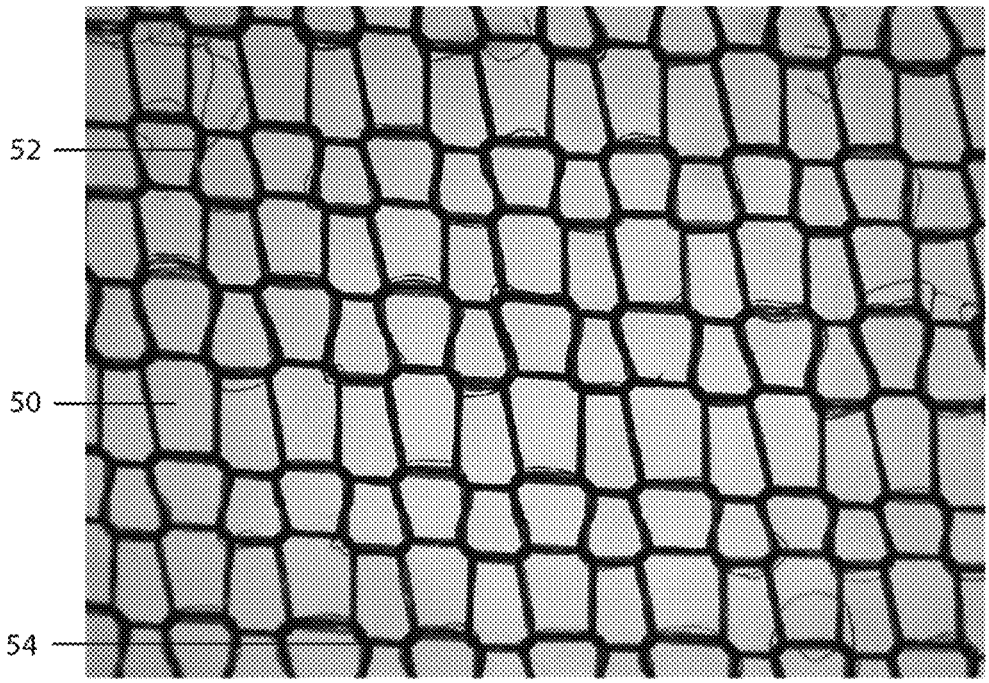
FIG. 5A is a photograph of plated black twisted UHMWPE and black spandex, taken at 65 times magnification.
Figure 5B:
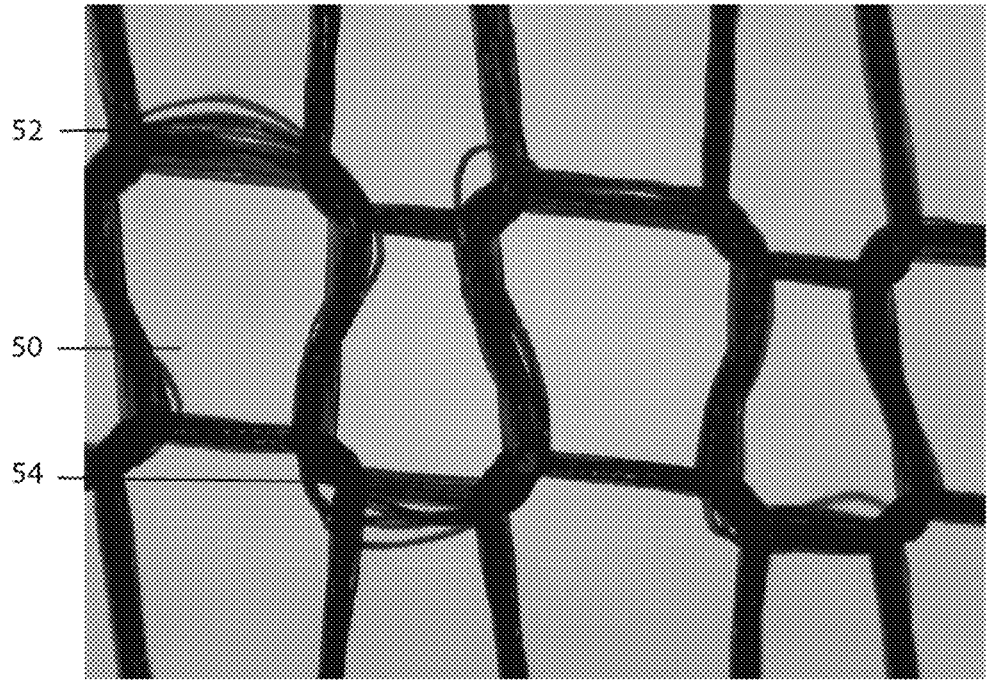
FIG. 5B is a photograph of plated black twisted UHMWPE and black spandex, taken at 225 times magnification.

For our purposes, plating refers to the knitting of UHMWPE with an elastic yarn or stretch fiber. In plating a UHMWPE fiber is required on every course of the knit and a stretch fiber can be on every course or every other course. After the knitting process, one side of the knit structure will expose the UHMWPE yarn more prominently (intended to go on the outside of the knit garment), and the elastic yarn (stretch fiber) is exposed on the other side (intended to go on the inside of the knit garment). This structure has UHMWPE yarn and the elastic yarn (stretch fiber) knit throughout the plated knit. FIGS. 5A (taken at 65 times magnification) and 5B (taken at 225 times magnification) shows an embodiment of a plated knit 50 with black UHMWPE 52 and black spandex 54. Turning to FIG. 5B, UHMWPE 52 can be seen to be plated to the spandex 54, while still being connected in each stitch.

A second method is to use "served" yarn, where the two fibers are twisted into one yarn. Twisted UHMWPE can be served with raw spandex (or other stretch fiber) of 5-100 denier using a conventional covering method to create a composite yarn. In a preferred embodiment, the twist on the conventional covering of the spandex (or other stretch fiber) with UHMWPE should be between 100-4500 twists per meter. A higher number of twists per meter may be desired. Increased twisting in the conventional covering ensures more stretch in the end product, and increased durability in the final knit as it results in a larger surface area of the spandex (or other stretch fiber) being reinforced with the UHMWPE. Experimental data by the applicant has shown conventional covering is very difficult to do with UHMWPE fibers thus a twist range of 1000-1500 has been found to be optimal and 1500 twists per metre is shown in most preferred embodiments.

In either plating or the use of a served composite yarn, higher denier spandex ensures a greater compression benefits to the end user. For compression applications the total compression should measure 15-20 mmHg or higher. The compression level can be adjusted upward by increasing the denier of the specific stretch material being used in the embodiment.

One of the primary limitations of UHMWPE, beyond it's lack of stretch, is that it is not dyeable. Not only is it non-porous, making a poor candidate for most traditional dyeing techniques, it is also unreceptive to most coatings, and until recently was only made in white. White is not a commercially desirable color for hosiery and similar categories of the apparel market in which black and nude shades are most commonly desired.

A common method for adding color to UHMWPE would be to cover it with another colored material though a conventional covering or braiding. For the purpose of making sheer hosiery these methods were not viable as they added too much bulk to the denier to the end fiber, unacceptably increasing the base yarn denier above 30 denier.

The present invention uses UHMWPE that is in the desired color of the end product and coloured using non-additive coloring methods. Non-additive means that the UHMWPE is colored using a method that does not add to the bulk or the denier of the UHMWPE. Two non-additive coloring methods are to add dye during the extrusion process, or supercritical CO2 dyeing (the details are beyond the scope of the present invention). Colored UHMWPE done using non-additive methods (which this document will call "colored UHMWPE") was not available until very recently, particularly in deniers below 100.

Figure 6:
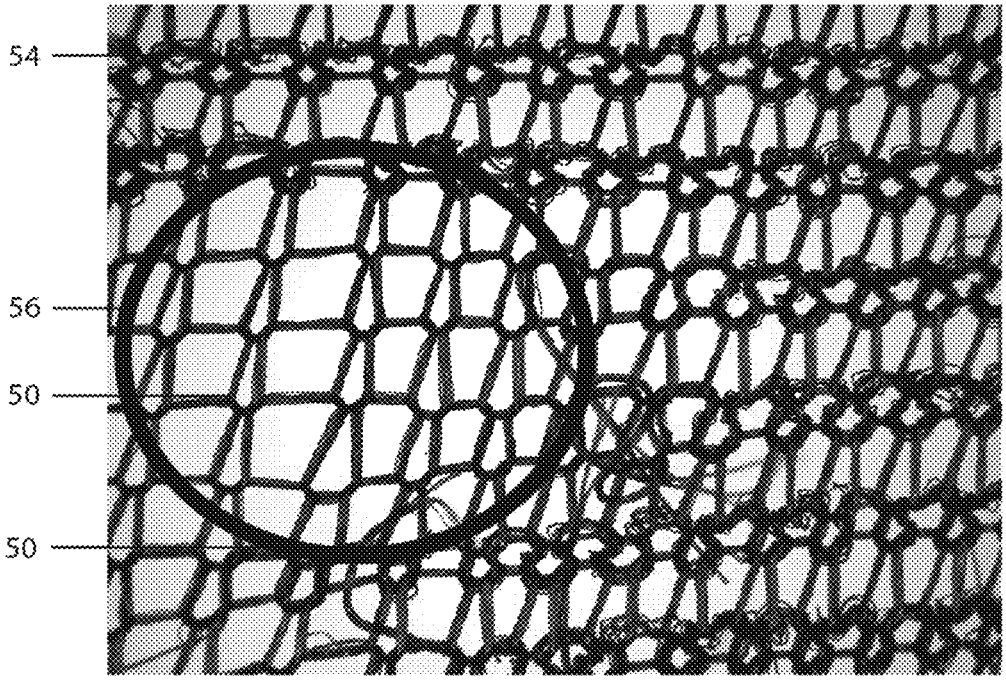
FIG. 6 is a photograph of a bald spot in the knit from FIGS. 5A and 5B taken at 65 times magnification.

A particular concern for sheer UHMWPE knits manufactured on a high gauge machine is that the stretch fiber (for example, spandex) layer may wear out before the UHMWPE layer, resulting in a patch that has a lower denier and less elasticity than the surrounding knit. This defect is referred to in the rest of this application as "bald spots". This is particularly likely to happen with UHMWPE blends with a stretch fiber, since (i) the UHMWPE is, as noted above, is particularly strong and resistant to ripping or otherwise wearing out or failing, (ii) the UHMWPE will rub against the stretch fiber, wearing the stretch fiber out, and (iii) outside forces impinging on the knit will erode the stretch fiber while often leaving the UHMWPE undamaged. The stretch fiber wearing out is aesthetically undesirable, and can lead to structural problems with the garment due to a localized loss of elasticity. Turning to FIG. 6, the knit from FIGS. 5A and 5B 50 has a bald spot 56, where the spandex 54 has worn away.

The bald spot problem can be addressed by using only clear stretch fiber, such as clear spandex. Then, even if the stretch fiber wears away, there is minimal difference in denier compared to the surrounding knit. However, the use of clear stretch fiber does not address the problem of a localized loss of elasticity. When the stretch fiber is spandex, clear spandex is also the highest tensile strength spandex, and so use of clear spandex adds to the durability of the end knit.

The bald spot problem can also be addressed by serving the colored UHMWPE and stretch fiber (such as spandex) as opposed to plating. Tests have shown that served knits of colored UHMWPE and stretch fiber (such as spandex) have significantly fewer bald spots after use than plated knits, and having less of an affect on the elasticity of the knit in the affected area that in plating. (Serving the colored UHMWPE and stretch fiber (such as spandex) also has the beneficial effect of reducing pilling.)

Even when bald spotting is non-apparent or reduced through the use of clear stretch fiber in a plated knit or clear stretch fiber served directly with UHMWPE, any remaining bald spotting results in an isolated loss of elasticity. To address this, abrasion pads may be integrated into areas like the inner thighs and feet of tights or stockings, where regular abrasion is expected, to add structural support. As used in this document, abrasion pads refer to non-UHMWPE knits and additive coatings that are integrated into an embodiment to prevent or at least delay bald spotting. Turning to FIG. 1, abrasion pads 60 are located on the heels of the tights 10 and abrasion pads 62 are located on the thighs of tights 10. In a preferred embodiment, a 70 denier nylon fiber and a 40 denier spandex fiber are knit on a 28 gauge machine to create inner thigh abrasion pads which are sewn to legs of tights made in with the inventive knit. In this same embodiment, the heels are dipped in a nitrile polymer coating to create abrasion pads on the feet. In another preferred embodiment, a 70 denier nylon fiber and a 40 denier spandex fiber are knit on a 28 gauge machine and are then sewn into the feet of a pair of tights to produce foot and heel abrasion pads. Both fiber and polymer created abrasion pads do not have the same strength, sheerness or anti-microbial properties of the UHMWPE knit of the present invention, and so they should only be used where needed to prevent abrasion. Abrasion pads are preferred in high gauge knits and optional in low gauge knits, where bald spots are more likely and apparent.

Three types of abrasion pads are preferred for use with this invention using either non-UHMWPE stretch fibers or polymers: 1) polymers that are applied as a coating to areas of high abrasion with methods such as painting or dipping; 2) abrasion pads that are integrated into the product through a seamless knit; and 3) abrasion pads that are integrated using a cut and sew method.

When knit into the product, abrasion pads may be transitioned into and out of in order to maintain strength at the seams, first adding the new fiber for the abrasion pad into the existing knit, and then transitioning the UHMWPE out of the knit. Due to the low melting point of UHMWPE, heat based adhesive abrasion pads are not a preferred option.

The present invention can be produced on circular, flat, or warp knitting machines. To produce a knit that is lightweight enough for hosiery the knitting machine used should be 32 gauge or higher. To produce a knit suitable for activewear like leggings, bodysuits, socks and shirt knits should be done on 18 gauge or higher machines.

Where there is need for stitching in the final assembly of the garment, an UHMWPE based thread should be used to ensure that these are not weak points for the product's durability.

While the description above has focussed on use of the invention for sheer hosiery, UHMWPE and stretch fiber (such as spandex) combinations can also be usefully applied to non-sheer products like semi-opaque to opaque hosiery and activewear. To achieve a non-sheer knit the total denier of the base fibers used in the knit should exceed 30 or the knit is produced on a knitting machine, below 32 gauge.

Activewear made using a UHMWPE and stretch fiber (such as spandex) knit has advantages over conventional activewear, specifically its greatly increased strength (for example, it would be difficult to wear a hole in a t-shirt manufactured from a UHMWPE and spandex knit), lightweight (in particular, its light weight compared to its strength), and anti-microbial properties.

The use of lower gauge knits will either eliminate or render non-apparent the pilling and bald spot problems encountered with sheer UHMWPE and stretch fiber (such as spandex) knits with a high gauge.

A knit may be created by using more than one UHMWPE fiber and/or more than one stretch fiber. A knit may be created by using more than one UHMWPE fiber and/or more than one spandex fiber.

In an embodiment, when used for sheer hosiery or similar garments, the above knits can be prepared using one UHMWPE of 30 denier or below, and one clear stretch fiber exhibiting elongation above 30% in deniers between 5 and 100, the total visible denier of the knit not exceeding 30, knit together on a 32 gauge or higher knitting machine. The UHMWPE used can either be served or plated with the stretch fiber, with served being a more preferred embodiment due to reduced appearance of bald spotting. In a preferred embodiment, UHMWPE suitable for use in sheer applications of this invention is UHMWPE fiber of 10-30 denier. A more preferred embodiment is 20-30 denier. In a preferred embodiment, a stretch fiber suitable for use in sheer applications of this invention is clear spandex fiber of 5-10 denier. A more preferred embodiment is 40-70 denier. The spandex used may preferably be clear.

In another embodiment, for non-sheer applications, like semi-opaque to opaque hosiery and activewear, the above knits can be prepared using one UHMWPE and one stretch fiber exhibiting elongation above 30%, the combined denier of the knit being between 30 and 220 denier, knit together on 18 gauge or higher knitting machine. For non-sheer applications, the UHMWPE used can either be served or plated with the stretch fiber, with neither embodiment resulting in apparent bald spotting. In one embodiment, UHMWPE suitable for use in non-sheer applications of this invention is UHMWPE fiber of 10-100 denier. A more preferred embodiment is UHMWPE fiber of 30-50 denier. In one embodiment, a stretch fiber suitable for use in non-sheer applications of this invention is spandex fiber of 20-140 denier. A more preferred embodiment is spandex fiber of 40-100 denier.

The minimum elongation of the stretch fiber should be 30% or higher. In a preferred embodiment the stretch fiber used exhibits elongation above 100%, and more preferably above 400%. The stretch fiber found to work best for the purposes of the present invention is spandex. Other alternatives stretch fibers could be made from polypropylene, polyester or nylon.

The UHMWPE used for testing exhibited a tensile strength of ≥40 cN per dtex and elongation of ≤3.5%. The stretch fiber used in testing, clear spandex unless otherwise indicated, exhibited elongation above 400%.

The below embodiments were assessed through manual testing for strength, manual testing for pilling and bald spotting, and wear tests.

Strength of the knit was assessed through manual testing. In manual tests, the end of a thumb is pressed against the knit as hard as possible in an attempt to make a hole in the knit. In successful testing, no hole is made. In unsuccessful testing the thumb goes through the knit.

Pilling and bald spotting were assessed through manual testing and wear testing. Pilling was tested manually by running a pointed object, like a diamond ring, against the knit while the knit is stretched out. In successful tests, no filaments pull from the knit and no pills were made. Bald spotting was tested manually by running a blunt object, like a pen, repeatedly against the knit while it is stretched out. This repeated motion breaks the spandex in the knit leaving the UHMWPE unbroken. In successful testing the bald spots are non-apparent or reduced. In wear tests, the knit is worn in various embodiments and are then subjected to visual inspection to look for bald spotting and pilling.

In one embodiment a coloured UHMWPE fiber of 30 denier is twisted to 12 TPI and then plated with a 40 denier clear spandex on a 32 gauge knitting machine. This resulted in a very strong, stretchy, sheer knit with visible denier not exceeding 30, with decreased elasticity over tests with 70 denier spandex, the fibers were found to be non-pilling and while bald spotting was present it was non-apparent in the knit.

In one embodiment a coloured UHMWPE fiber of 30 denier is twisted to 12 TPI and then plated with a 70 denier clear spandex on a 32 gauge knitting machine. This resulted in a very strong, stretchy, sheer knit with visible denier not exceeding 30, with increased elasticity over tests with 40 denier spandex, the fibers were found to be non-pilling and while bald spotting was present is was non-apparent in the knit.

In one embodiment a coloured UHMWPE fiber of 30 denier is twisted to 12 TPI and then plated with a 70 denier black spandex on a 28 gauge knitting machine. This resulted in a very strong, stretchy, non-sheer knit (visible denier exceeding 30), with increased elasticity over tests with 40 denier spandex, the fibers were found to be non-pilling and there was no apparent bald spotting in the knit.

In one embodiment a coloured UHMWPE fiber of 30 denier is twisted to 12 TPI and then plated with a 40 denier black spandex on a 28 gauge knitting machine. This resulted in a very strong, stretchy, non-sheer knit (visible denier exceeding 30), with decreased elasticity over tests with 70 denier spandex, the fibers were found to be non-pilling and there was no apparent bald spotting in the knit.

In one embodiment a coloured UHMWPE fiber of 30 denier is twisted to 12 TPI and served with 40 denier clear spandex at 1500 TPM and is then knit on a 32 gauge knitting machine. This resulted in a very strong, stretchy, sheer knit (visible denier not exceeding 30). In manual testing the fibers were found to be non-pilling, the likelihood of bald spotting was significantly reduced when compared to plated knitting with the same base fibers, and bald spots had less of an impact on the elasticity of the knit when they did occur.

Other embodiments tested that resulted in comparable examples are detailed below.

In one comparative example a coloured UHMWPE fiber of 20 denier was not twisted and knit on a 32 gauge knitting machine. This resulted in a very strong, not-stretchy, sheer knit (visible denier not exceeding 30), very significant pulls and pilling, and no visible bald spotting throughout the knit.

In one comparative example a coloured UHMWPE fiber of 20 denier was not twisted and then knit with 40 denier covered spandex on a 32 gauge knitting machine. This resulted in a very weak, stretchy, non-sheer knit (visible denier exceeding 30), very significant pulls and pilling, and visible bald spotting throughout the knit.

In one comparative example a coloured UHMWPE fiber of 20 denier is twisted to 6 TPI and then plated with a 40 denier black raw spandex on a 32 gauge knitting machine. This resulted in a very strong, stretchy, non-sheer knit (visible denier exceeding 30), significant pulls and pilling, and visible bald spotting throughout the knit.

In one comparative example a coloured UHMWPE fiber of 20 denier is twisted to 9 TPI and then plated with a 40 denier black raw spandex on a 32 gauge knitting machine. This resulted in a very strong, stretchy, non-sheer knit (visible denier exceeding 30), significant pulls and pilling (although reduced from that of tests done with 6 TPI UHMWPE fiber) and visible bald spotting throughout the knit.

In one comparative example a coloured UHMWPE fiber of 30 denier is twisted to 12 TPI and then plated with a 40 denier black raw spandex on a 32 gauge knitting machine. This resulted in a very strong, stretchy, non-sheer knit (visible denier exceeding 30), significantly reduced pilling, and very visible bald spotting throughout the knit.

Although the foregoing description and accompanying drawings relate to specific preferred embodiments of the present invention as presently contemplated by the inventor, it will be understood that various changes, modifications and adaptations may be made that would be known to a person skilled in the art.

What is claimed is:

1. A knit comprising consisting of a multifilament ultra-high molecular weight polyethylene (UHMWPE) fiber and a stretch fiber, wherein:

a) the stretch fiber is selected from spandex, polypropylene and polyester fibers and has an elongation of greater than 30%;

b) filaments of the multifilament UHMWPE fiber are twisted together at a twists per inch (TPI) between 4 and 20;

c) the multifilament UHMWPE fiber comprises a dye and has a denier of 30 or less, an elongation of less than or equal to 3.5% and a tensile strength of greater than or equal to 40 cN per dtex; and d) the knit is a plated knit having the multifilament UHMWPE fiber on each course and the stretch fiber on at least every other course such that the knit has the multifilament UHMWPE fiber being exposed on a first side of the knit and the stretch fiber being exposed on a second side of the knit opposite the first side and having an apparent denier not exceeding 30.

2. The knit of claim 1, wherein the multifilament UHMWPE fiber comprises 20 filaments.

3. The knit of claim 1, wherein the multifilament UHMWPE fiber has a denier between 10 and 30.

4. The knit of claim 1, wherein the multifilament UHMWPE fiber has a denier between 20 and 30.

5. The knit of claim 1, wherein the filaments are twisted together at a TPI between 6 and 15.

6. The knit of claim 1, wherein the filaments are twisted together at a TPI of 15.

7. The knit of claim 1, wherein the filaments are twisted together at a TPI of 12.

8. The knit of claim 1, wherein the stretch fiber has an elongation of greater than 100%.

9. The knit of claim 1, wherein the stretch fiber has an elongation of greater than 400%.

10. The knit of claim 1, wherein the stretch fiber comprises spandex.

11. The knit of claim 10, wherein the spandex is clear spandex.

12. The knit of claim 1, wherein the stretch fiber comprises polypropylene.

13. The knit of claim 1, wherein the stretch fiber comprises polyester.

14. The knit of claim 1, wherein the stretch fiber has a denier ranging from 5 to 10.

15. The knit of claim 1, wherein the knit has a gauge of 32 or higher.

16. The knit of claim 1, wherein the knit comprises the stretch fiber on every course.

17. The knit of claim 1, wherein the filaments are extruded filaments comprising a dye.

18. The knit of claim 17, wherein the dye is selected from black and nude colors.

19. An article of clothing comprising the knit of claim 1.

20. The article of clothing of claim 19, wherein the article of clothing is tights, stockings or trouser socks.

21. The knit of claim 1, wherein the stretch fiber has a denier between 40 and 70 and the multifilament UHMWPE fiber has a denier ranging from 10 to 30.

* * * * *